US012742280B2

(12) United States Patent
Červenka et al.

(10) Patent No.: US 12,742,280 B2
(45) Date of Patent: Sep. 22, 2026

(54) BLOWER ASSEMBLY FOR MINIMIZING PRESSURE LOSS IN AN APPLIANCE

(71) Applicant: Haier US Appliance Solutions, Inc., Wilmington, DE (US)

(72) Inventors: Bystrik Červenka, Nuremberg (DE); David Scott Dunn, Louisville, KY (US); Jivko Ognianov Djerekarov, Louisville, KY (US); David G. Beers, Newberry, IN (US); Dimitar Tcholakov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 677 days.

(21) Appl. No.: 18/305,204

(22) Filed: Apr. 21, 2023

(65) Prior Publication Data

US 2024/0352659 A1 Oct. 24, 2024

(51) Int. Cl.
*D06F 58/20* (2006.01)
*D06F 58/02* (2006.01)

(52) U.S. Cl.
CPC ..... *D06F 58/20* (2013.01); *D06F 58/02* (2013.01)

(58) Field of Classification Search
CPC ..... D06F 58/02; D06F 58/20
USPC ..... 34/241
See application file for complete search history.

(56) References Cited

U.S. PATENT DOCUMENTS

| | | | | |
|---|---|---|---|---|
| 7,278,823 | B2 | 10/2007 | Platz | |
| 9,909,249 | B2 * | 3/2018 | Kim | D06F 58/22 |
| 11,371,181 | B2 | 6/2022 | Yu et al. | |
| 2012/0102781 | A1 * | 5/2012 | Beers | D06F 58/206 34/499 |
| 2016/0290358 | A1 * | 10/2016 | Hayamitsu | F04D 29/281 |
| 2018/0051409 | A1 | 2/2018 | Yu et al. | |
| 2020/0025209 | A1 * | 1/2020 | Stanley | F04D 29/281 |
| 2022/0220968 | A1 * | 7/2022 | Peng | F04D 29/281 |
| 2022/0307185 | A1 | 9/2022 | Djerekarov et al. | |

FOREIGN PATENT DOCUMENTS

| | | | | |
|---|---|---|---|---|
| CN | 102560989 | A | 7/2012 | |
| CN | 107762971 | A * | 3/2018 | F04D 29/30 |
| DE | 102007022097 | A1 * | 11/2008 | D06F 58/04 |
| JP | 6162948 | B2 | 7/2017 | |
| JP | 2021025477 | A | 2/2021 | |

OTHER PUBLICATIONS

English Translation of DE102007022097 A1 (Year: 2007).*
English Translation of CN 107762971 A (Year: 2018).*

* cited by examiner

*Primary Examiner* — Connor J Tremarche
(74) *Attorney, Agent, or Firm* — Dority & Manning, P.A.

(57) ABSTRACT

An airflow system for a laundry appliance is provided. The laundry appliance has a cabinet for receiving one or more articles for washing or drying. The airflow system includes a duct assembly, a heat exchanger, and a blower assembly. The duct assembly defines an airflow path between an air inlet for receiving air from the cabinet and an air outlet for returning air into the cabinet. The heat exchanger is disposed between the air inlet and the air outlet. The blower assembly directs airflow along the airflow path. Further, during operation of the laundry appliance, the blower assembly directs the airflow through the air outlet, across the heat exchanger, through the air inlet, and back into the cabinet.

17 Claims, 7 Drawing Sheets

BLOWER ASSEMBLY FOR MINIMIZING PRESSURE LOSS IN AN APPLIANCE

FIELD OF THE INVENTION

The present disclosure relates generally to dryer appliances and/or combination washer and dryer appliances, and more particularly to a blower assembly for such appliances that minimizes pressure losses during a drying cycle thereof.

BACKGROUND OF THE INVENTION

Combination washer and dryer appliances have become increasingly popular in recent years. In particular, combination washer and dryer appliances are often attractive because of the utility and space savings of having one appliance performing the functions of two similarly sized appliances.

Sufficient airflow is critical to any laundry appliance, particularly in fulfilling the requirements of a drying cycle for combination washer and dryer appliances. Many conventional combination units rely on a blower assembly to assist with the drying cycle. The blower assembly often includes a housing and a motor to drive an impeller positioned within the housing to rotate the impeller to urge an airflow along an airflow path through the drying appliance.

However, issues may arise in such systems due to relatively low airflow, which limits the performance of the appliance during the drying cycle. Low airflow requires longer drying cycles because the decreased airflow limits the mass flow rate of water vapor to an evaporator, for example, where moisture is removed from the air. Such limitations are exacerbated when a larger load of laundry has been added. Larger laundry loads generate an additional pressure drop, which further reduces airflow and thus further limits the drying rate. Such limits on airflow and the drying rate demand higher power draw to cover the pressure drop to complete a drying cycle.

Accordingly, a blower assembly that maximizes available space in a laundry appliance while delivering sufficient drying air at an efficient airflow rate would be welcomed in the art. As such, the present disclosure is directed to a blower assembly configured to maximize available space in a laundry appliance and to provide increased airflow rates and reduce pressure losses.

BRIEF DESCRIPTION OF THE INVENTION

Aspects and advantages of the invention will be set forth in part in the following description, or may be obvious from the description, or may be learned through practice of the invention.

In an aspect, the present disclosure is directed to a laundry appliance. The laundry appliance includes a cabinet, an airflow path, a blower, and a heat exchanger. The cabinet defines an interior volume for receiving one or more articles for washing or drying. The cabinet has a cabinet inlet and a cabinet outlet. The airflow path is defined between the cabinet inlet and the cabinet outlet. The blower assembly is configured to direct airflow through the cabinet and along the airflow path. The heat exchanger is arranged adjacent to the blower assembly along the airflow path. Further, during operation of the laundry appliance, the blower assembly directs the airflow through the cabinet outlet, across the heat exchanger, through the cabinet inlet, and back into the cabinet.

In another aspect, the present disclosure is directed to an airflow system for a laundry appliance having a cabinet for receiving one or more articles for washing or drying. The airflow system includes a duct assembly, a heat exchanger, and a blower assembly. The duct assembly defines an airflow path between an air inlet for receiving air from the cabinet and an air outlet for returning air into the cabinet. The heat exchanger is disposed between the air inlet and the air outlet. The blower assembly directs airflow along the airflow path. Further, during operation of the laundry appliance, the blower assembly directs the airflow through the air outlet, across the heat exchanger, through the air inlet, and back into the cabinet.

In yet another aspect, the present disclosure is directed to a laundry appliance. The laundry appliance includes a cabinet, a laundry basket, an airflow path, a blower assembly, a heat exchanger, and a duct system. The cabinet defines an interior volume for receiving one or more articles for washing or drying. The cabinet also has a cabinet inlet and a cabinet outlet. The laundry basket is rotatably mounted within the cabinet and defines a chamber for receiving articles for treatment. The airflow path is defined between the cabinet inlet and the cabinet outlet. The blower assembly defines a radial direction, a circumferential direction, and an axial direction. The blower assembly is configured to direct airflow through the cabinet and along the airflow path. Moreover, the blower assembly includes a housing, a motor, and an impeller. The housing defines a housing inlet and a housing outlet. The housing of the blower assembly also has a front wall spaced apart from a rear wall along the axial direction to define a rectangular volute. The rear wall of the housing defines an annular receptacle. The motor is positioned within the annular receptacle. The impeller is mechanically coupled to the motor for rotating the impeller about an axis of rotation to urge an airflow from the cabinet outlet to the cabinet inlet along the airflow path. The impeller is positioned within the rectangular volute. The heat exchanger is configured to heat and remove moisture from the airflow passing therethrough. The duct system includes an intake duct and a return duct. The duct system also provides fluid communication between the cabinet outlet and the housing inlet via the intake duct and between the housing outlet and the cabinet inlet via the return duct. The duct system, the blower assembly, and the chamber define the airflow path. Further, during operation of the laundry appliance, the blower assembly directs the airflow through the cabinet outlet, across the heat exchanger, through the cabinet inlet, and back into the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
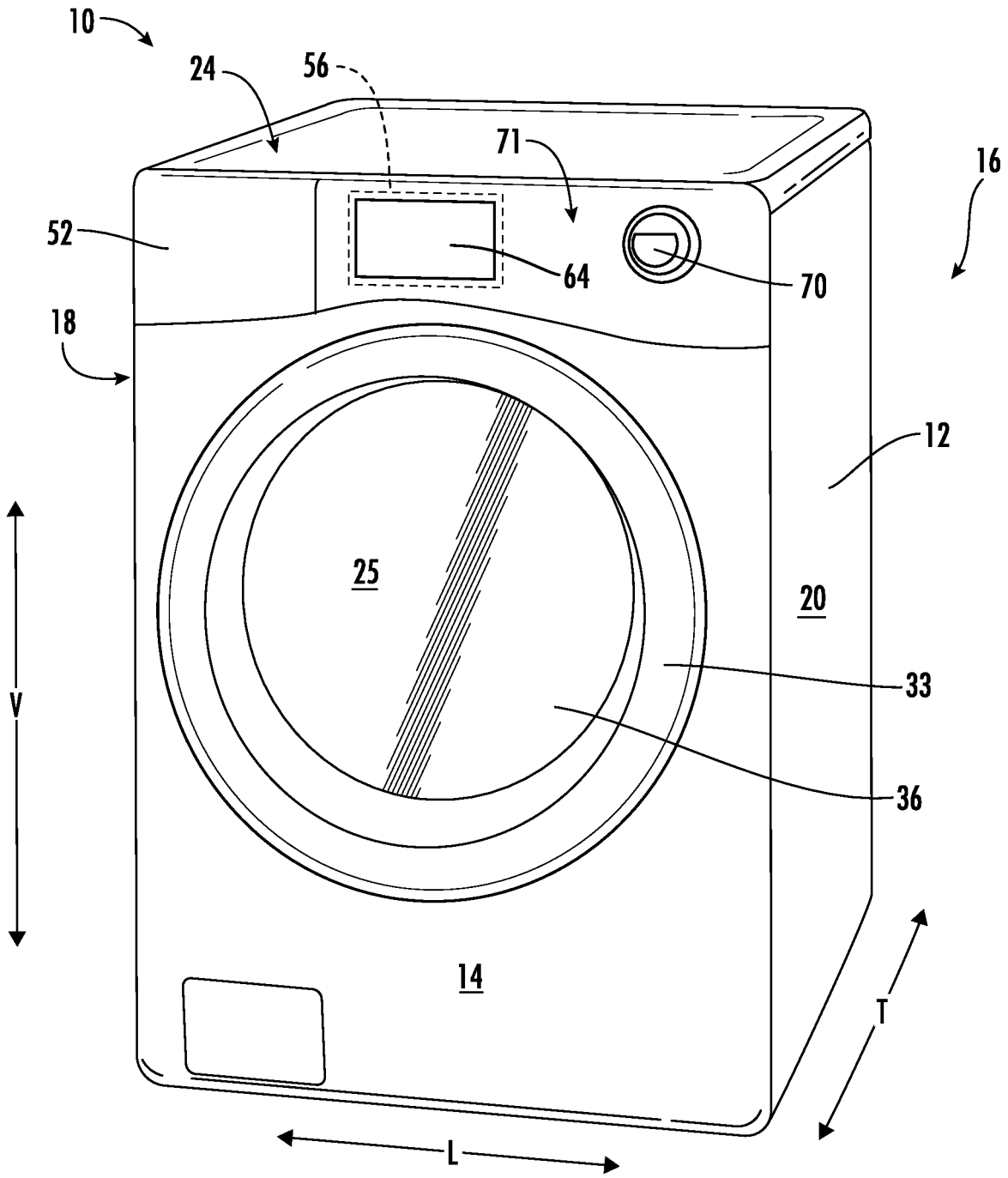
FIG. 1 provides a front, perspective view of a laundry appliance in accordance with an embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

In general, the present disclosure provides a blower assembly for minimizing pressure loss in an appliance, particularly in a combination washer and dryer appliance. In an embodiment, for example, the blower assembly includes a high efficiency centrifugal blower with backward curved blades and an asymmetric rectangular close (tight) casing volute. As such, the blower assembly is designed to maximize available space in the appliance while efficiently delivering sufficient drying air at an optimal airflow rate. Moreover, the blower assembly is positioned within in a way that provides the shortest distance for an airflow path. In addition, positioning and configuration of the blower assembly provides low pressure losses throughout the airflow path. Further, the blower assembly is configured to be compact and positioned to allow for sufficient rotational speeds resulting in low noise emission.

Figure 2:
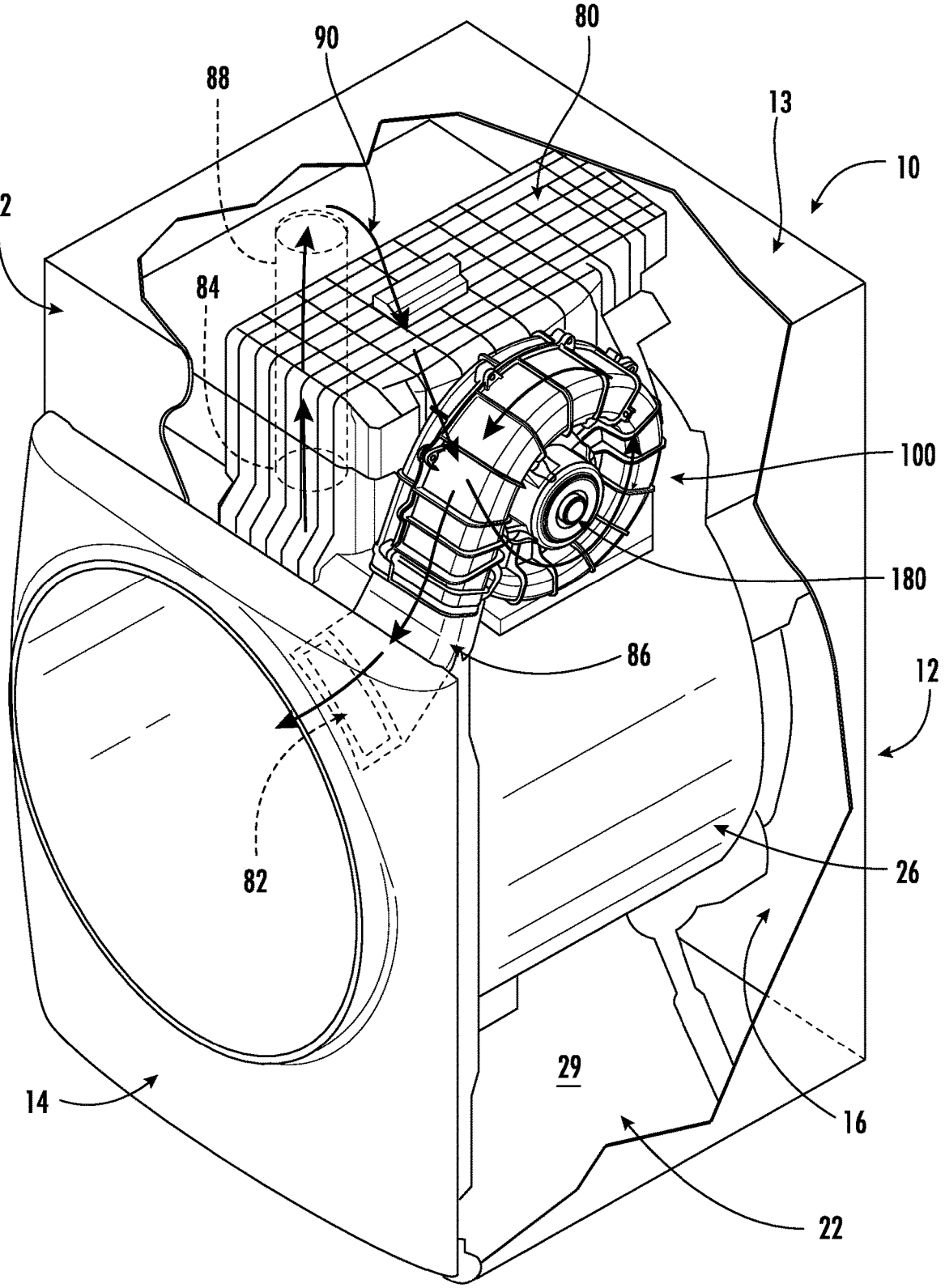
FIG. 2 provides an internal, perspective view of the laundry appliance of FIG. 1 with a portion of a cabinet of the laundry appliance removed to reveal certain internal components of the laundry appliance.

Referring now to the drawings, FIGS. 1 and 2 illustrate various views of a the laundry appliance 10 according to exemplary embodiments of the present disclosure. Further, as shown, the laundry appliance 10 defines a vertical direction V, a lateral direction L, and a transverse direction T. The vertical, lateral, and transverse directions are mutually perpendicular and form an orthogonal direction system. Thus, in an embodiment, as shown, the laundry appliance includes a cabinet 12 having a front panel 14, a rear panel 16, a left side panel 18 and a right side panel 20 spaced apart from each other by the front and rear panels 14 and 16, a bottom panel 22, and a top panel 24. Further, as shown, the cabinet 12 extends along the vertical direction V between the top panel 24 and the bottom panel 22. Moreover, as shown, the cabinet 12 extends along the transverse direction T between the front panel 14 and the rear panel 16. As used herein, terms such as "left" and "right" or "front" and "back" refer to directions from the perspective of a user facing the laundry appliance 10 for accessing and/or operating the laundry appliance 10.

In particular embodiments, as shown, the laundry appliance 10 is a combination washer/dryer appliance and may also be referred to herein as a multifunction laundry appliance or washer/dryer combination appliance. While described in the context of an embodiment of the laundry appliance 10, using the teachings disclosed herein, it will be understood that the laundry appliance 10 is provided by way of example only. Other laundry appliances having different appearances and different features may also be utilized with the present subject matter as well. Furthermore, as used herein, the terms "articles," "clothing," or "laundry" include but need not be limited to fabrics, textiles, garments, linens, papers, or other items which may be cleaned, dried, and/or otherwise treated in a laundry appliance.

Referring particularly to FIGS. 1 and 2, in an embodiment, a drum 26 or tub may be mounted within the cabinet 12. More particularly, the drum 26 or tub is mounted within an interior volume 13 of the cabinet 12, as shown in FIG. 2. A laundry basket may be mounted within the drum 26, defining a chamber for receipt of articles of clothing for treatment, e.g., washing, rinsing, spinning, tumbling, and/or drying.

In some embodiments, as shown in FIG. 1, one or more selector inputs 70, such as knobs, buttons, touchscreen interfaces, etc., may be provided or mounted on the cabinet 12, e.g., on a control panel 71 thereof and are in operable communication (e.g., electrically coupled or coupled through a wireless network band) with a processing device or controller 56. The control panel 71 may also include a display 64. The controller 56 may also be provided in operable communication with various components of the laundry appliance 10, such as the various components of a blower assembly 100 (described herein below) and/or a heat exchanger 80 of the laundry appliance 10. In turn, signals generated in the controller 56 direct operation of such components in response to the inputs 70. As used herein, "controller" may refer to one or more microprocessors, microcontroller, ASICS, or semiconductor devices and is not restricted necessarily to a single element. The controller 56 may be programmed to operate laundry appliance 10 by executing instructions stored in memory (e.g., non-transitory media).

The controller 56 may include, or be associated with, one or more memory elements such as RAM, ROM, or electrically erasable, programmable read only memory (EEPROM). For example, the instructions may be software or any set of instructions that when executed by the controller 56, cause the controller 56 to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller 56.

Still referring to FIG. 1, the laundry appliance 10 may include an access door 33 having a window 36 for viewing of a chamber 25 and/or laundry articles therein, e.g., during operation of the laundry appliance 10. Furthermore, as shown, the laundry appliance 10 may include a detergent drawer 52 slidably mounted within front panel 14. Thus, in an embodiment, the detergent drawer 52 receives an additive (e.g., detergent, fabric softener, bleach, or any other suitable liquid or powder) and directs the additive to the chamber 25 during operation of the laundry appliance 10.

Referring now to FIGS. 2-6, the laundry appliance 10 further includes a blower assembly 100 for minimizing pressure loss in an appliance, particularly in a combination washer and dryer appliance, such as laundry appliance 10. Accordingly, in an embodiment, the blower assembly 100 of the present disclosure is designed to maximize available space in the laundry appliance 10 while efficiently delivering sufficient drying air at an optimal airflow rate.

Figure 5:
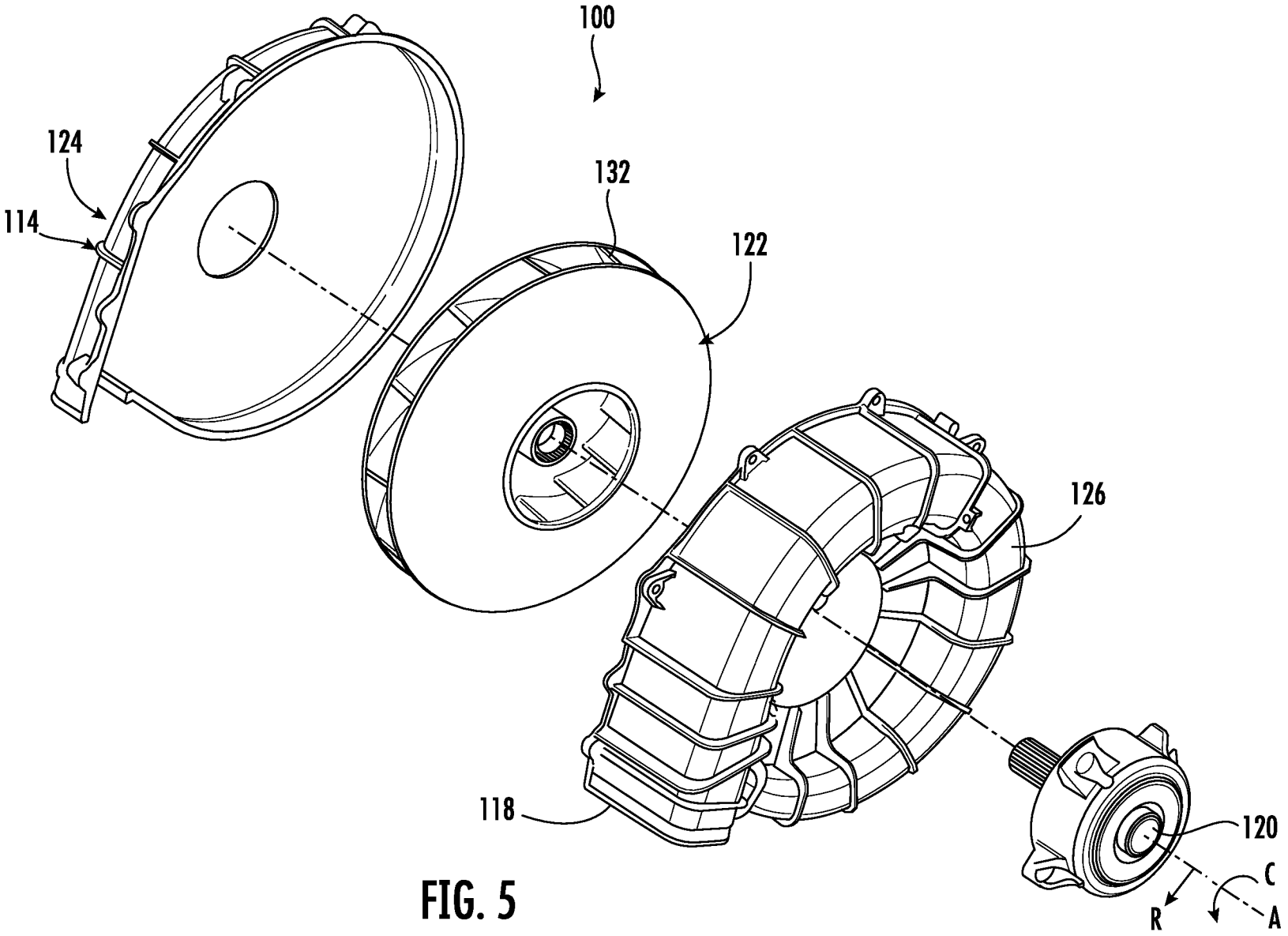
FIG. 5 provides an exploded view of an exemplary blower assembly for a laundry appliance in accordance with an embodiment of the present disclosure.
Figure 6:
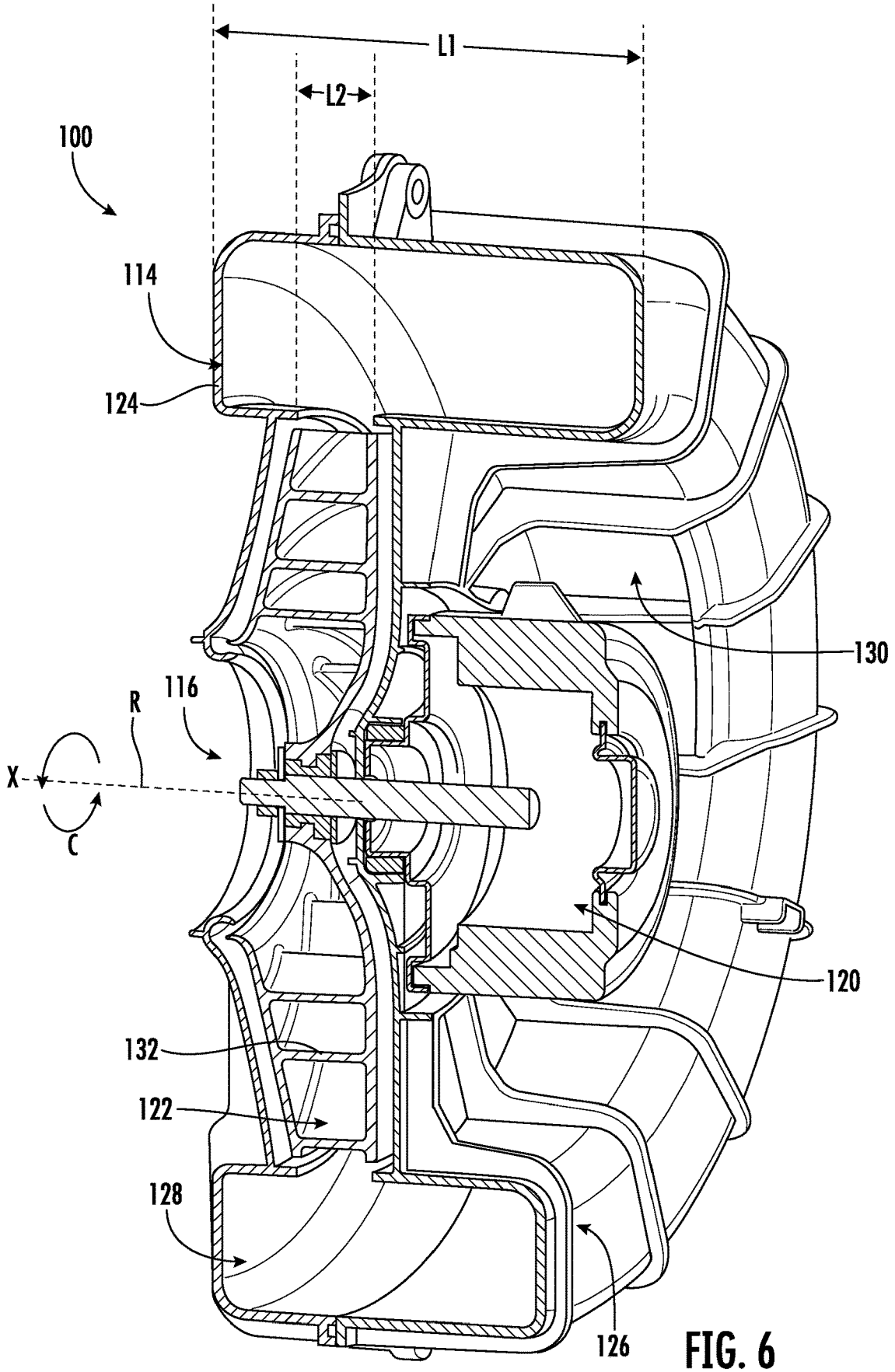
FIG. 6 provides a sectional, perspective view of the exemplary blower assembly of FIG. 5.

In particular embodiments, as shown, the cabinet 12 includes a cabinet inlet 82 and a cabinet outlet 84 defining an airflow path 90 between the cabinet inlet 82 and the cabinet outlet 84. In an embodiment, for example, the cabinet inlet 82 may be located proximate the front panel 14, whereas the cabinet outlet 84 may be located proximate the rear panel 16. Thus, the blower assembly 100 is configured for directing airflow through the cabinet 12 and along the airflow path 90. For example, as shown in FIGS. 5 and 6, the blower assembly 100 defines a radial direction R, a circumferential direction C. and an axial direction A. Further, as shown, the blower assembly 100 includes a housing 114 defining an air inlet 116 (FIG. 6), an air outlet 118 (FIG. 5), a motor 120, and an impeller 122 arranged within the housing 114 and mechanically coupled to the motor 120 for rotating the impeller 122 in the circumferential direction.

In certain embodiments, as shown in FIGS. 5 and 6, the impeller 122 of the blower assembly 100 may a centrifugal impeller having a plurality of backwardly curved prismatic blades 132 spaced apart along the circumferential direction. Thus, the motor 120 is configured to drive rotation of the impeller 122 within the housing 114 about an axis of rotation to direct airflow from the air inlet 116 along the airflow path 90. In an embodiment, for example, the axis of rotation may be concentrically aligned with the axial direction A. Additionally, the impeller 122 and prismatic blades 132 are configured to allow for a relatively simple production process of such components. Moreover, the backwardly curved prismatic blades 132 can have an outlet blade angle over 140 degrees to allow for energy efficiencies during operation of the blower assembly over a wide range of operating points, as will be discussed further with respect to FIG. 7. In some embodiments, the outlet blade angle of the prismatic blades 132 can be about 100 degrees to 170 degrees, 110 degrees to 160 degrees, 125 to 150 degrees, or 135 degrees to 145 degrees.

Furthermore, as shown in FIGS. 5 and 6, the housing 114 of the blower assembly 100 includes a front wall 124 spaced apart from a rear wall 126 along the axial direction A to define a volute 128. Moreover, as shown, the volute 128 may have any suitable cross section, such as a rectangular cross section. Accordingly, in an embodiment, the air inlet 116 defined in the front wall 124 receives air therethrough, while the rear wall 126 defines an annular receptacle 130 for receiving the motor 120.

Further, as shown, the heat exchanger 80 is arranged adjacent to the blower assembly 100 along the airflow path 90. Accordingly, during operation of the laundry appliance 10, the blower assembly 100 directs the airflow through the cabinet outlet 84, across the heat exchanger 80, through the cabinet inlet 82, and into the cabinet 102. As such, the blower assembly 100 is configured to provide sufficient airflow to enable the laundry appliance 10 to perform a drying cycle effectively. In addition, the heat exchanger 80 is arranged adjacent to the blower assembly 100 along the airflow path 90 to increase the efficiency of the drying cycle. By directing the airflow in the described manner, the blower assembly 100 ensures that the air exiting the cabinet 12 passes over the heat exchanger 80, where the air is heated, and then circulated back into the cabinet 12 to remove moisture from the laundry.

Figure 3:
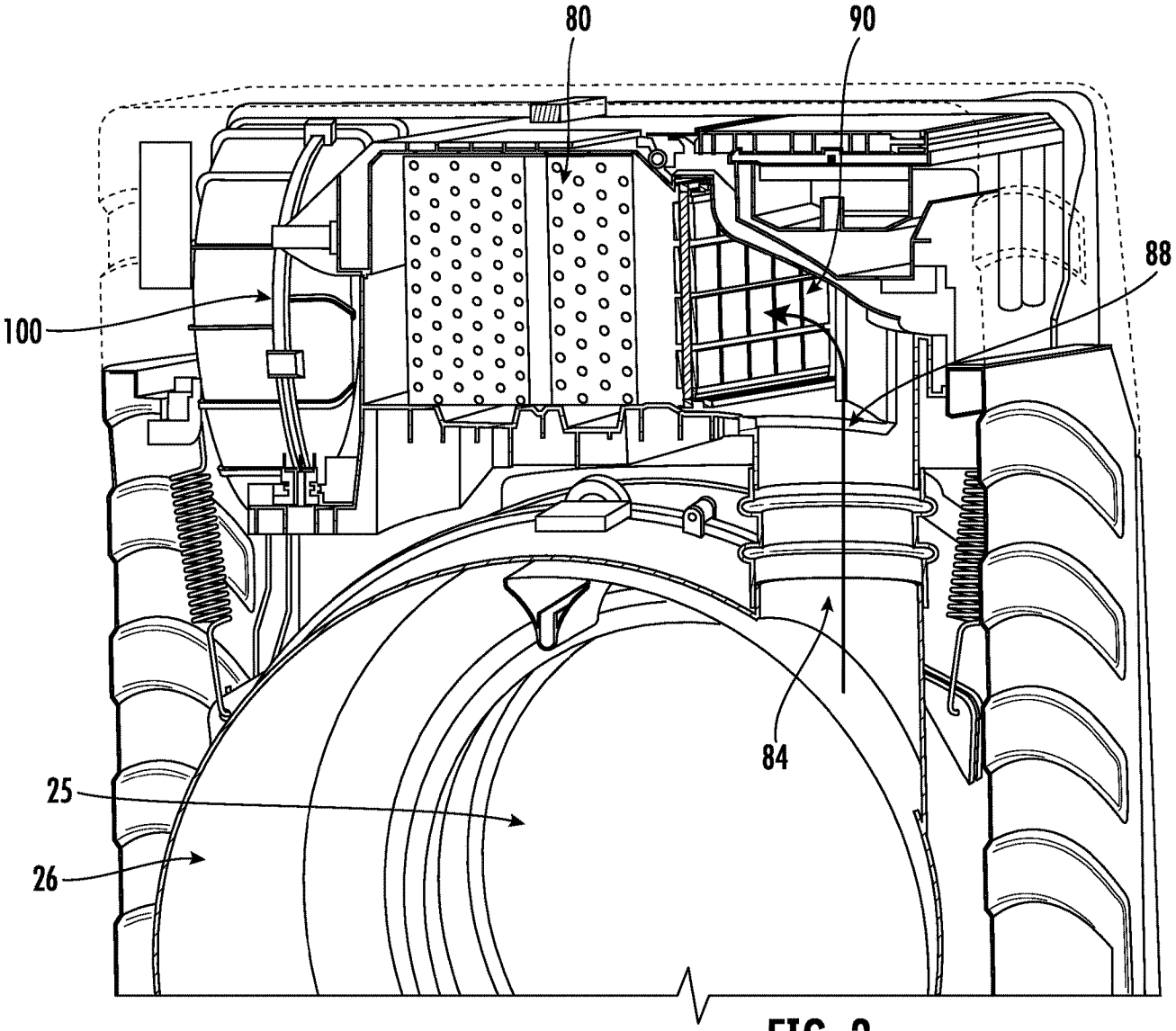
FIG. 3 provides an internal, rear view of the laundry appliance of FIG. 1.
Figure 4:
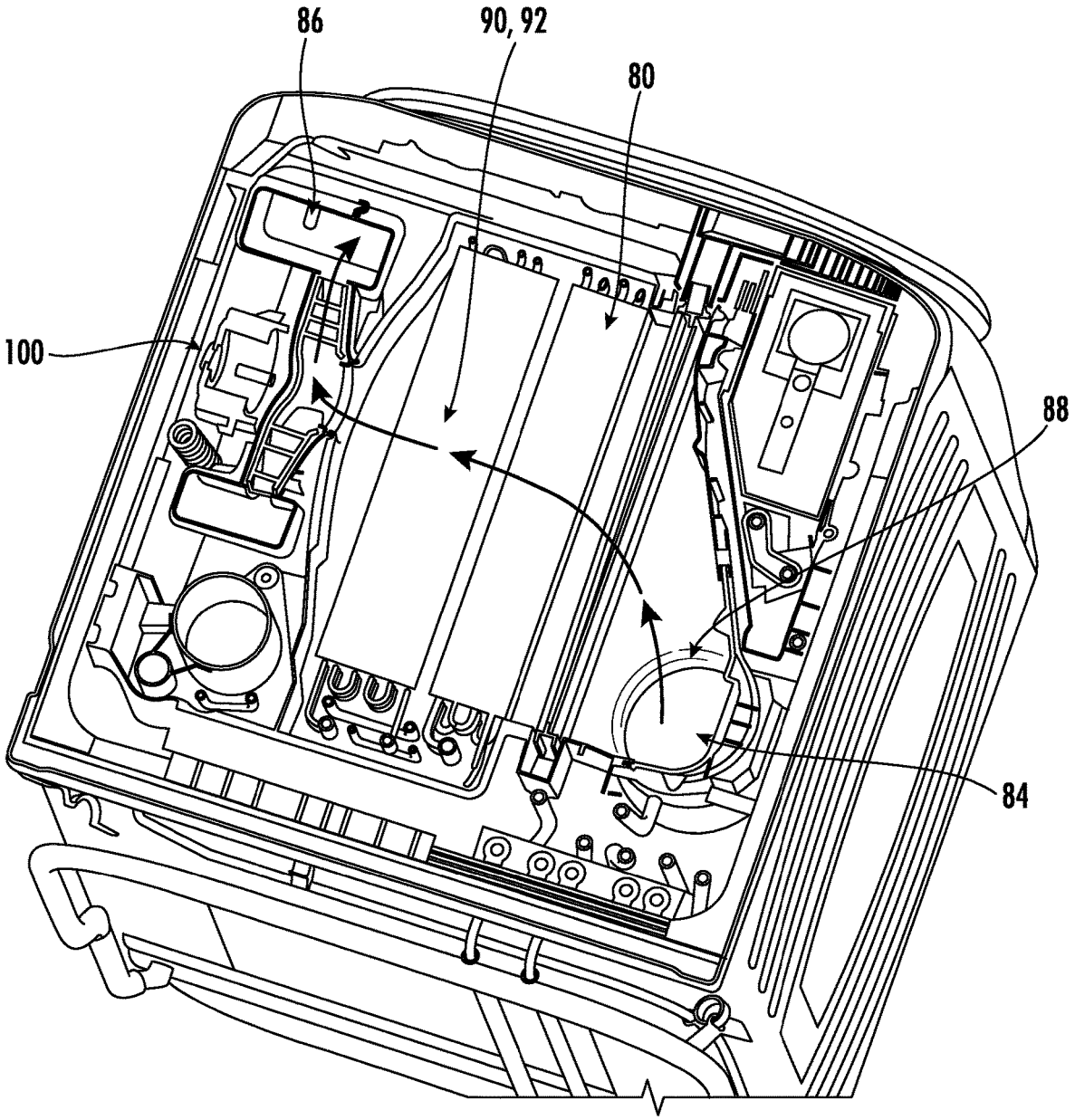
FIG. 4 provides an internal, top view of the laundry appliance of FIG. 1.

In an embodiment, the blower assembly 100 and the heat exchanger 80 are located on top of the cabinet 12, as depicted in FIGS. 2-4, for example. Specifically, in an embodiment, the blower assembly 100 and heat exchanger 80 are arranged on the top of the cabinet 102 such that the blower assembly 100 and the heat exchanger 80 are located above the drum 26. In such embodiments, this arrangement maximizes available space within the cabinet 102 while delivering sufficient drying air at an efficient airflow rate. More specifically, the blower assembly 100 is positioned within the cabinet 12 in a way that provides the shortest distance for the airflow path 90. Further, the positioning of the air inlet 116 (FIG. 6) and the air outlet 118 (FIG. 5) of the housing 114 of the blower assembly 100 is designed in a way that also helps provide the shortest distance for the airflow path 90. In addition, the positioning of the air inlet 116 and the air outlet 118 provide low pressure losses throughout the airflow path 90. Moreover, the blower assembly 100 is configured to be compact and positioned to allow for sufficient rotational speeds resulting in low noise emission.

Referring particularly to FIG. 4, the airflow path 90 may be defined by a duct system 92 having an intake duct 88 and a return duct 86. In such embodiments, the duct system 92 provides fluid communication between the cabinet outlet 84 and the cabinet inlet 82 (FIG. 2) via the intake duct 88. Further, the duct system 92 is configured to provide fluid communication between the cabinet outlet 84 and the cabinet inlet 82 via the return duct 86. Accordingly, the duct system 92, the blower assembly 100, and the chamber 25 (FIG. 3) define the airflow path 90.

Figure 7:
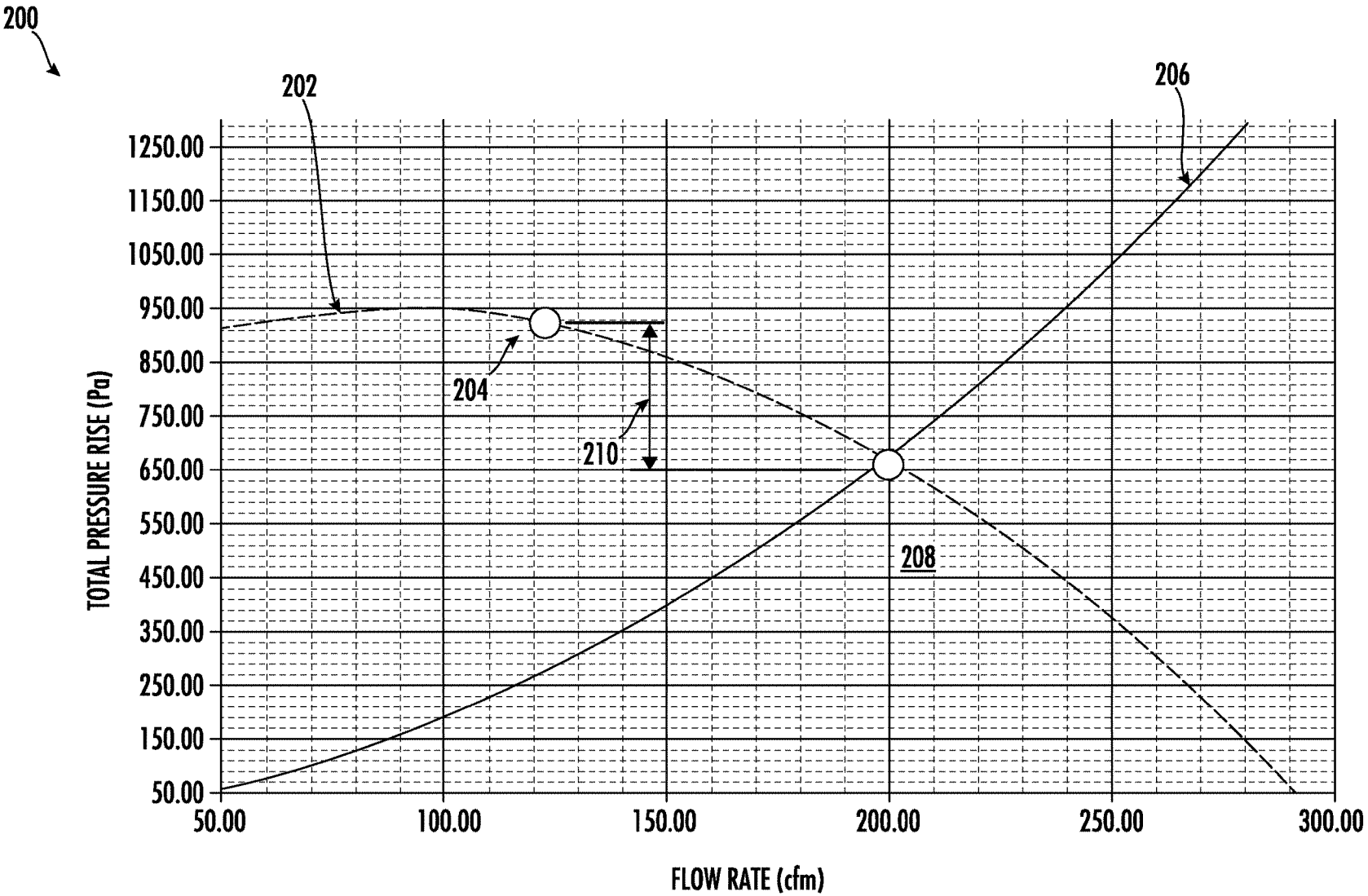
FIG. 7 provides a graph of total pressure rise (in unit pascals) (y-axis) versus flow rate (in cubic feet per minute (CFM)) (x-axis) for a blower assembly of a laundry appliance in accordance with an embodiment of the present disclosure.

Referring now to FIG. 7, a graph 200 of total pressure rise (Pa) (y-axis) versus flow rate (CFM) (x-axis) generated by a laundry appliance in accordance with an embodiment of the present disclosure is illustrated. As previously described, the laundry appliance has a blower assembly configured to minimize pressure losses and maximize available space. Thus, as shown in the illustrated graph 200, curve 202 represents the pressure rise across the blower assembly operating at a range of flow rates. Moreover, as shown, point 204 represents the maximum pressure at which operation of the blower assembly is stable. In addition, as shown, curve 206 represents a system resistance curve that shows the pressure resistance through a closed-loop system (e.g., a pressure resistance of the system for a range of flow rates through the system such as the pressure resistance represented/posed by all components in the airflow path, except for the blower assembly). Accordingly, as shown, curve 202 and curve 206 intersect at an operating point 208 of the blower assembly. Thus, as shown, a difference 210 in total pressure between point 204 and the operating point 208 provides an allowance for inefficiencies germane to drying operations of a laundry appliance, such as filter clogging. Thus, as shown, the blower assembly described herein allows for improved pressure conditions within the laundry appliance such that there is an improved flow rate.

Accordingly, as shown, in an embodiment, the blower assembly of the present disclosure provides a drying air flow rate of at least about 200 cubic feet per minute (CFM) and a pressure difference of at least about 600 Pa. This efficient airflow and pressure difference enhances the overall performance of the laundry appliance during the drying cycle, minimizing pressure losses and reducing drying time. More specifically, the high flow rate and pressure difference are achieved through the design of the blower assembly and the position of the blower assembly in relation to the heat exchanger and the airflow path, including the air inlet and the air outlet. These features allow for efficient movement of air through the laundry appliance, resulting in effective drying performance.

In summary, the present disclosure provides a laundry appliance, such as a combination washer and dryer appliance, with a blower assembly configured to minimize pressure losses and maximize available space. The blower assembly directs airflow through the cabinet, across a heat exchanger, and back into the cabinet, promoting efficient drying of the laundry load. The unique design of the blower assembly, including the housing, impeller, and motor arrangement, allows for improved airflow rates and reduced pressure losses, resulting in a more efficient and effective drying process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance, comprising:

a cabinet defining an interior volume for receiving one or more articles for washing or drying, the cabinet having a cabinet inlet and a cabinet outlet;

an airflow path defined between the cabinet inlet and the cabinet outlet;

a blower assembly configured for directing airflow through the cabinet and along the airflow path, the blower assembly comprising a housing defining a housing inlet and a housing outlet, a motor, and a centrifugal impeller arranged within the housing and mechanically coupled to the motor for rotating the impeller in a circumferential direction, the centrifugal impeller comprising a plurality of backwardly curved prismatic blades spaced apart along the circumferential direction and having an outlet blade angle of at least 100 degrees; and a heat exchanger arranged adjacent to the blower assembly along the airflow path, wherein, during operation of the laundry appliance, the blower assembly directs the airflow through the cabinet outlet, across the heat exchanger, through the cabinet inlet, and back into the cabinet, wherein the blower assembly provides a drying air flow rate of at least about 200 cubic feet per minute (cfm) and a pressure difference ranging from of at least about 600 Pa to less than about 1000 Pa.

2. The laundry appliance of claim 1, wherein the blower assembly is located on top of the cabinet.

3. The laundry appliance of claim 2, wherein the blower assembly and the heat exchanger are positioned on top of the cabinet.

4. The laundry appliance of claim 1, wherein the cabinet extends between a top portion and a bottom portion along a vertical direction and between a front portion and a rear portion along a transverse direction, the cabinet inlet being located proximate at least one of the front portion or the top portion, the cabinet outlet being located proximate at least one of the rear portion or the top portion.

5. The laundry appliance of claim 1, wherein the heat exchanger is disposed between the cabinet outlet of the cabinet and the housing inlet of the blower assembly.

6. The laundry appliance of claim 1, wherein the housing of the blower assembly comprises a front wall spaced apart from a rear wall along an axial direction to define a volute within which the impeller is positioned, the front wall defining the housing inlet upstream of the impeller to permit air therethrough, the rear wall defining an annular receptacle for receiving the motor.

7. The laundry appliance of claim 6, wherein the volute comprises a rectangular cross section.

8. The laundry appliance of claim 6, wherein the rear wall of the housing has an exterior surface defining the annular receptacle, the annular receptacle having a receptacle depth extending in the axial direction and a receptacle diameter concentrically aligned with the impeller, the motor being at least partially enclosed by the exterior surface of the rear wall when received by the annular receptacle.

9. The laundry appliance of claim 1, wherein the outlet blade angle is at least 140 degrees.

10. The laundry appliance of claim 1, wherein the laundry appliance is a washer-dryer combination appliance.

11. An airflow system for a laundry appliance having a cabinet for receiving one or more articles for washing or drying, the airflow system comprising:

a duct assembly defining an airflow path between an air inlet for receiving air from the cabinet and an air outlet for returning air into the cabinet;

a heat exchanger disposed between the air inlet and the air outlet; and a blower assembly for directing airflow along the airflow path, the blower assembly comprising a housing defining a housing inlet and a housing outlet, a motor, and a centrifugal impeller arranged within the housing and mechanically coupled to the motor for rotating the impeller in a circumferential direction, the centrifugal impeller comprising a plurality of backwardly curved prismatic blades spaced apart along the circumferential direction and having an outlet blade angle of at least 100 degrees, wherein, during operation of the laundry appliance, the blower assembly directs the airflow through the air outlet, across the heat exchanger, through the air inlet, and back into the cabinet, wherein the blower assembly provides a drying air flow rate of at least about 200 cubic feet per minute (cfm) and a pressure difference ranging from of at least about 600 Pa to less than about 1000 Pa.

12. The airflow system of claim 11, wherein the blower assembly and the heat exchanger are positioned on top of the cabinet.

13. The airflow system of claim 11, wherein the heat exchanger is disposed between the air outlet and the housing inlet of the blower assembly.

14. The airflow system of claim 11, wherein the housing of the blower assembly comprises a front wall spaced apart from a rear wall along an axial direction to define a volute within which the impeller is positioned, the front wall defining the housing inlet upstream of the impeller to permit air therethrough, the rear wall defining an annular receptacle for receiving the motor.

15. The airflow system of claim 14, wherein the volute comprises a rectangular cross section.

16. The airflow system of claim 14, wherein the rear wall of the housing has an exterior surface defining the annular receptacle, the annular receptacle having a receptacle depth extending in the axial direction and a receptacle diameter concentrically aligned with the impeller, the motor being at least partially enclosed by the exterior surface of the rear wall when received by the annular receptacle.

17. A laundry appliance, comprising:

a cabinet defining an interior volume for receiving one or more articles for washing or drying, the cabinet having a cabinet inlet and a cabinet outlet;

a laundry basket rotatably mounted within the cabinet, the laundry basket defining a chamber for receipt of articles for treatment;

an airflow path defined between the cabinet inlet and the cabinet outlet;

a blower assembly defining a radial direction, a circumferential direction, and an axial direction, the blower assembly being configured for directing airflow through the cabinet and along the airflow path, the blower assembly comprising:

a housing defining a housing inlet and a housing outlet, the housing comprising a front wall spaced apart from a rear wall along the axial direction to define a rectangular volute, the rear wall defining an annular receptacle;

a motor positioned within the annular receptacle;

a centrifugal impeller being mechanically coupled to the motor for rotating the centrifugal impeller about an axis of rotation in the circumferential direction to urge an airflow from the cabinet outlet to the cabinet inlet along the airflow path, the impeller being positioned within the rectangular volute, the centrifugal impeller comprising a plurality of backwardly curved prismatic blades spaced apart along the circumferential direction and having an outlet blade angle of at least 100 degrees; and a heat exchanger configured to heat and remove moisture from the airflow passing therethrough; and a duct system comprising an intake duct and a return duct, the duct system providing fluid communication between the cabinet outlet and the housing inlet via the intake duct and between the housing outlet and the cabinet inlet via the return duct, wherein the duct system, the blower assembly, and the chamber define the airflow path, and wherein, during operation of the laundry appliance, the blower assembly directs the airflow through the cabinet outlet, across the heat exchanger, through the cabinet inlet and back into the cabinet, wherein the blower assembly provides a drying air flow rate of at least about 200 cubic feet per minute (cfm) and a pressure difference ranging from of at least about 600 Pa to less than about 1000 Pa.

* * * * *